United States Patent [19]

Golicz et al.

[11] 4,299,073

[45] Nov. 10, 1981

[54] MACHINE AND METHOD FOR PACKAGING TRAVELERS CHECKS

[75] Inventors: Roman M. Golicz, Clinton; William H. Gunther, Jr., Mystic; James W. Hough, Madison, all of Conn.

[73] Assignee: American Express Company, New York, N.Y.

[21] Appl. No.: 93,001

[22] Filed: Nov. 9, 1979

[51] Int. Cl.[3] ..... B65B 57/16; B65B 11/48

[52] U.S. Cl. ..... 53/493; 53/206; 53/209

[58] Field of Search ..... 53/460, 206, 209, 520, 53/493; 271/9; 414/54; 235/431; 198/421

[56] References Cited

U.S. PATENT DOCUMENTS

| | | | |
|---|---|---|---|
| 3,099,118 | 7/1963 | Stelling | 53/209 |
| 3,162,434 | 12/1964 | Hepp | 53/206 |
| 3,414,257 | 12/1968 | Muller | 198/421 |
| 3,454,149 | 7/1969 | Nigrelli et al. | 53/209 |
| 3,457,696 | 7/1969 | Berkley | 53/460 |
| 3,626,660 | 12/1971 | Dorfmann | 53/209 |
| 3,983,679 | 10/1976 | Zemke | 53/460 |
| 4,059,261 | 11/1977 | Brown | 271/9 |
| 4,071,997 | 2/1978 | Gunther, Jr. | 53/460 |
| 4,091,596 | 5/1978 | Jones | 53/460 |
| 4,115,981 | 9/1978 | Hell et al. | 53/520 X |

*Primary Examiner*—John Sipos

*Attorney, Agent, or Firm*—Holland, Armstrong, Wilkie & Previto

[57] ABSTRACT

A machine and method for packaging travelers checks in which the checks are automatically packaged in predetermined denominations and in predetermined amounts.

3 Claims, 32 Drawing Figures

F
S 1
5
6
4

I
C
2
5
C
3
P
4

112
111
31
32
30
C
P
I
2
22
34
104
101
102
107
108
109
110
114
115
3
105
106

118
4
5
3
112
110
120
122
128
129
30
29
28
31
116
121
115
114
109
101
34
21
2
1

MACHINE AND METHOD FOR PACKAGING TRAVELERS CHECKS

DESCRIPTION

The present invention is directed to a machine and method for packaging travelers checks and more particularly to an improved machine and method for sorting and packaging checks in predetermined denominations and in predetermined amounts.

When purchasing travelers checks, the purchaser usually indicates to the issuing company the amount of checks he wishes to purchase. The issuing officer counts out the desired numbers of checks and the purchaser signs each check in the presence of the issuing officer. The purchaser thereafter countersigns each check as each check is cashed. In addition, a record of the check numbers is usually made at the time the checks are issued so that should the checks be lost or stolen, the loss or theft may be reported to the issuing company for a refund. As will be readily seen, this practice is a time-consuming and expensive one both for the issuing company and for the consumer.

In order to reduce the time involved in issuing such travelers checks, machines have been developed for pre-packaging checks in the more popular amounts purchased, such as $100 or $200. In such existing machines, a number of checks in predetermined denominations are sorted out and stuffed into envelopes. However with existing prepackaging machines there is difficulty in making certain that the right documents are actually packaged within a particular envelope. Errors sometimes occur whereby checks of one denomination are placed in envelopes with checks of other denominations and miscounts are sometimes made which may stuff more or less documents in a particular envelope.

The present invention eliminates these drawbacks and has for one of its objects the provision of an improved machine and method for packaging travelers checks which insures that the proper documents are packaged in the proper envelope.

Another object of the present invention is the provision of an improved machine and method of packaging travelers checks which provides for detection of any failures in the packaging system.

Another object of the present invention is the provision of an improved machine and method of packaging travelers checks which will relay the reason for any failure of the system, as well as the failure itself to the operator of the machine.

Another object of the present invention is the provision of an improved machine and method of packaging travelers checks which enables the serial numbers of the documents to be read as they are assembled for insertion into an envelope so that the documents may be positively identified as the correct ones for inclusion in a particular envelope.

Another object of the present invention is the provision of an improved machine and method of packaging travelers checks which includes fixed monitor points throughout the entire system to be certain that the proper checks are inserted into the proper envelopes.

Another object of the present invention is the provision of an improved machine and method of packaging travelers checks which may be adapted to package checks of different denominations in a single package.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 5 is a perspective view showing the feed mechanisms used with the present invention.

FIG. 32 is a logic diagram of the operation of the present machine.

GENERAL OPERATION

In general the machine handles a group of travelers checks in which their serial numbers have been pre-numbered and arranged sequentially and a group of Purchaser Application Forms (hereafter PAF) which have also had their serial numbers pre-numbered and arranged sequentially.

These documents are placed into separate feed mechanisms. Means are provided to feed the documents individually from each feed mechanism and move it past a scanning mechanism in order to read the serial number of each.

The documents are then deposited onto holding means. After the proper number of documents have been deposited on the holding means, a conveyor, which has had an envelope blank already placed on it, is moved forward. The conveyor removes the documents from the holding means and deposits them onto the envelope blank. The conveyor then moves the envelope blank with the documents stacked thereon past an additional insert depositing station so that additional inserts can be placed on the envelope blank. The package is then moved to the folding and gluing station where the envelope is folded around the documents and sealed.

The Package

Figures 1, 2, 3:
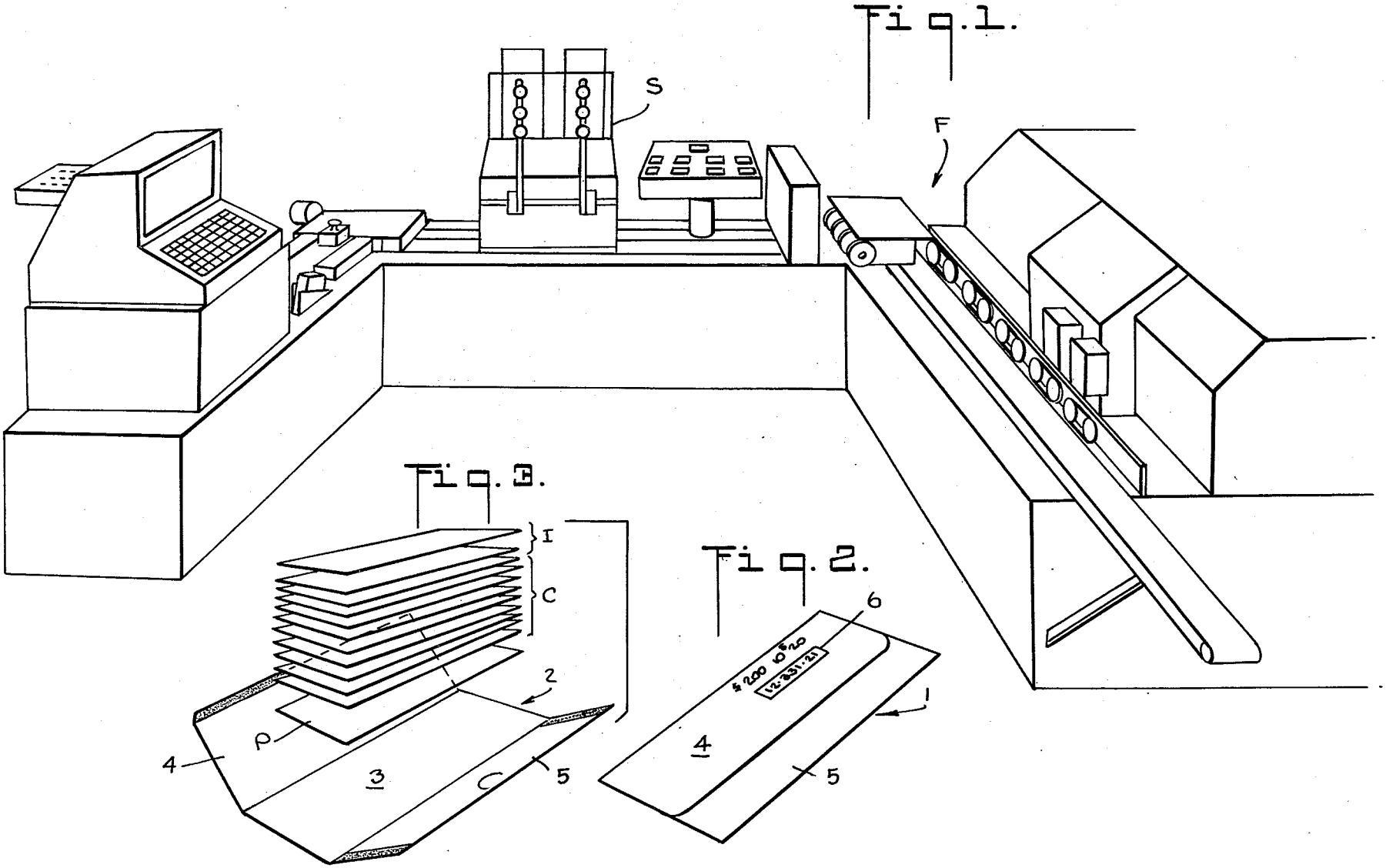
FIG. 1 is a perspective diagrammatic view of a machine made in accordance with the present invention.
FIG. 2 is a perspective view of a package of travelers checks made in accordance with the present invention.
FIG. 3 is an exploded view showing the package and its contents.

The travelers check package 1 of the present invention is shown in FIGS. 2 and 3 and comprises an envelope blank 2 having a central panel 3, an end panel 5 and a kite flap 4. The travelers checks C as well as a Purchase Agreement Form P (hereinafter PAF), are stacked on the end panel 5 together with any additional inserts I which may be desired to be packaged therewith. The documents P and C are arranged on the end panel 5 with the front faces thereof facing downwardly. The end panel 5 is narrower than the documents P and C so that a portion of the documents P and C extends beyond the rear edge of panel 5. The serial numbers on the documents P and C are located on this extension so that the serial numbers on these documents are beyond the edge of end panel 5. The PAF P has a serial number thereon which matches the lowest serial number in the stack of travelers checks C which are to be packaged together.

The envelope blank 2 is folded over the stacked travelers checks C, the PAF P and the additional inserts I and is sealed to complete the package 1. It will be noted that the flap 4 has a window 6 therein which overlies the serial number on the protruding portion of the documents P and C stacked on panel 5 so that the serial number of the PAF P can be seen through the window 6.

With travelers checks C pre-packaged as described above, a person purchasing travelers checks will obtain a travelers check package 1 from the issuing company. The PAF P having the pertinent serial number information is removed from the package 1 and signed by the purchaser. The signed PAF P is left with the issuing officer and a portion thereof containing the numbers of the checks is kept by the purchaser together with the travelers checks C. The purchaser then signs his name on all the checks C at his leisure and thereafter countersigns each check as each is cashed by him.

General Description

Figure 4:
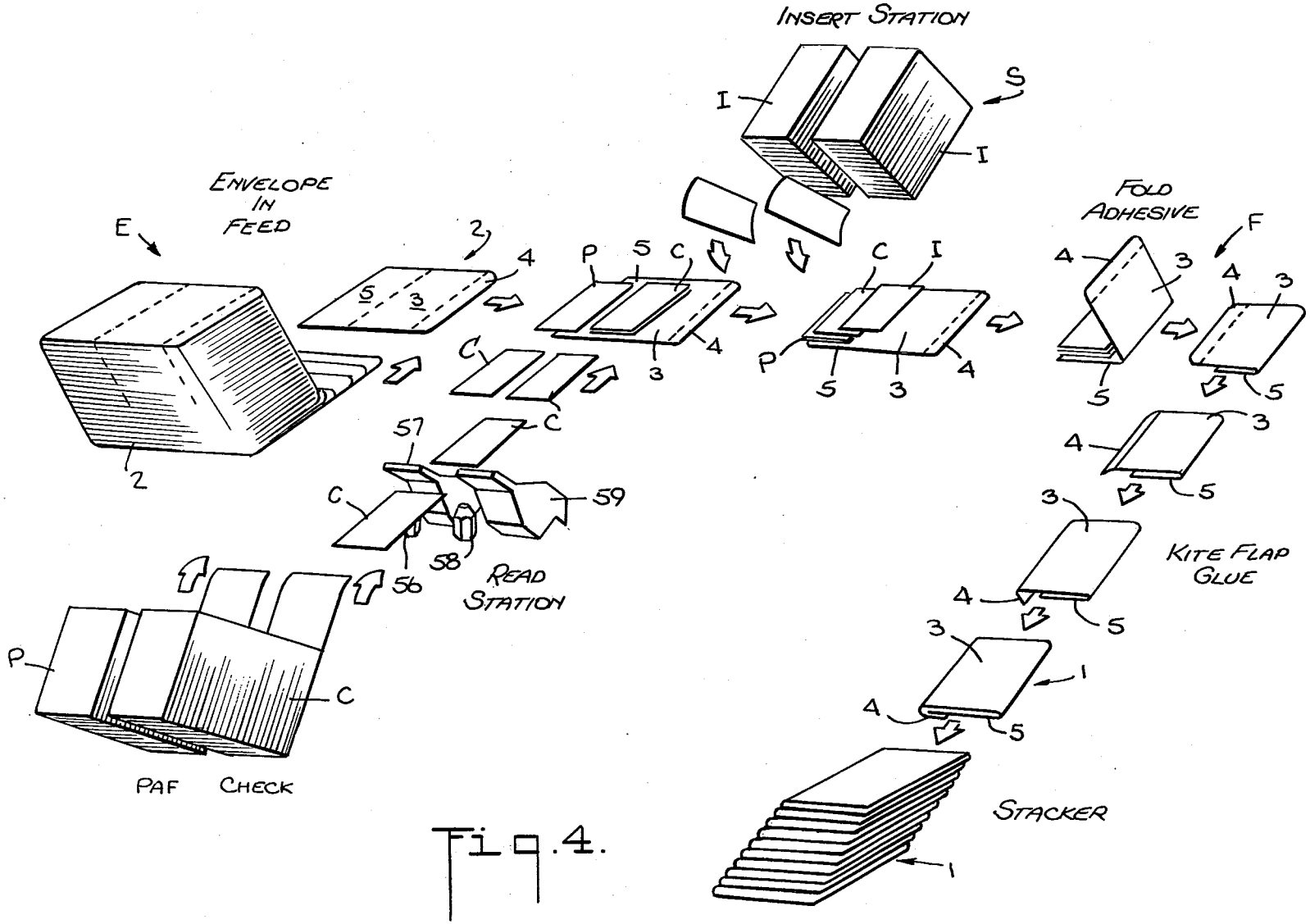
FIG. 4 is a diagrammatic view of the operation of the machine showing the various steps in the method of practicing the present invention.
Figure 13:
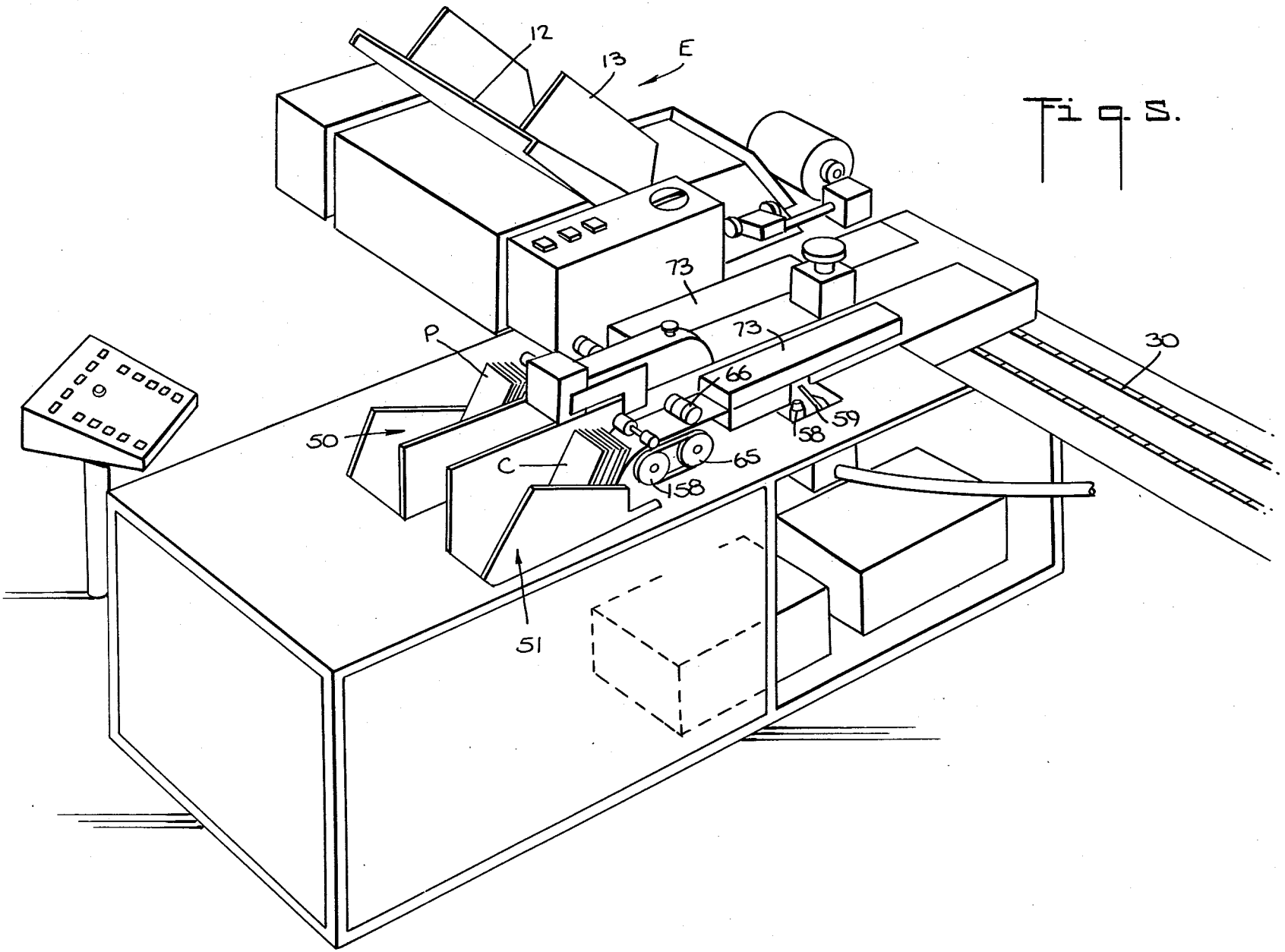
FIG. 13 is a sectional view taken along line 13—13 of FIG. 11.
Figures 6, 19:
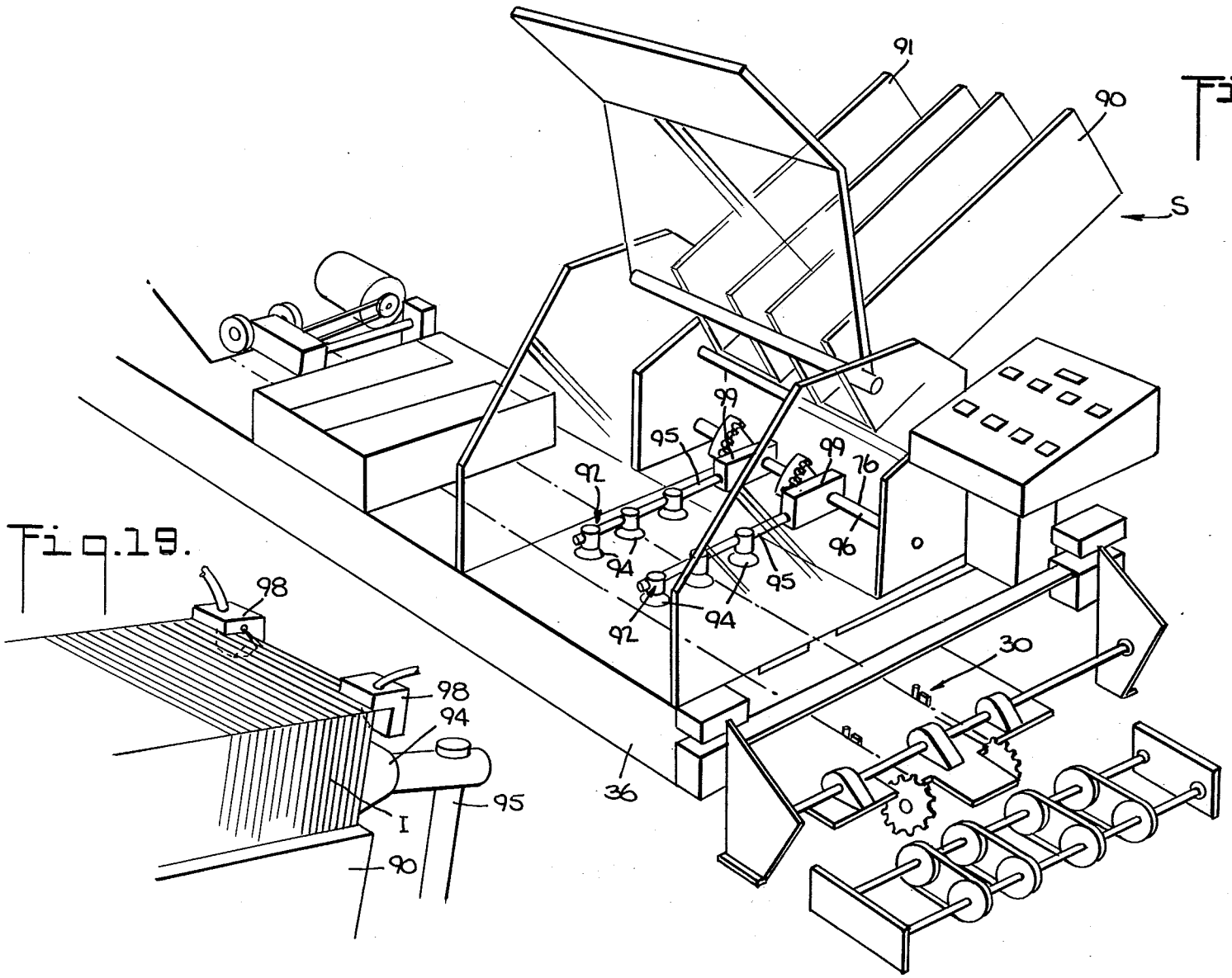
FIG. 6 is a perspective view showing the mechanism for feeding inserts to the package.
FIG. 19 is a detailed perspective view showing the mechanism for separating additional inserts from each other.
Figure 7:
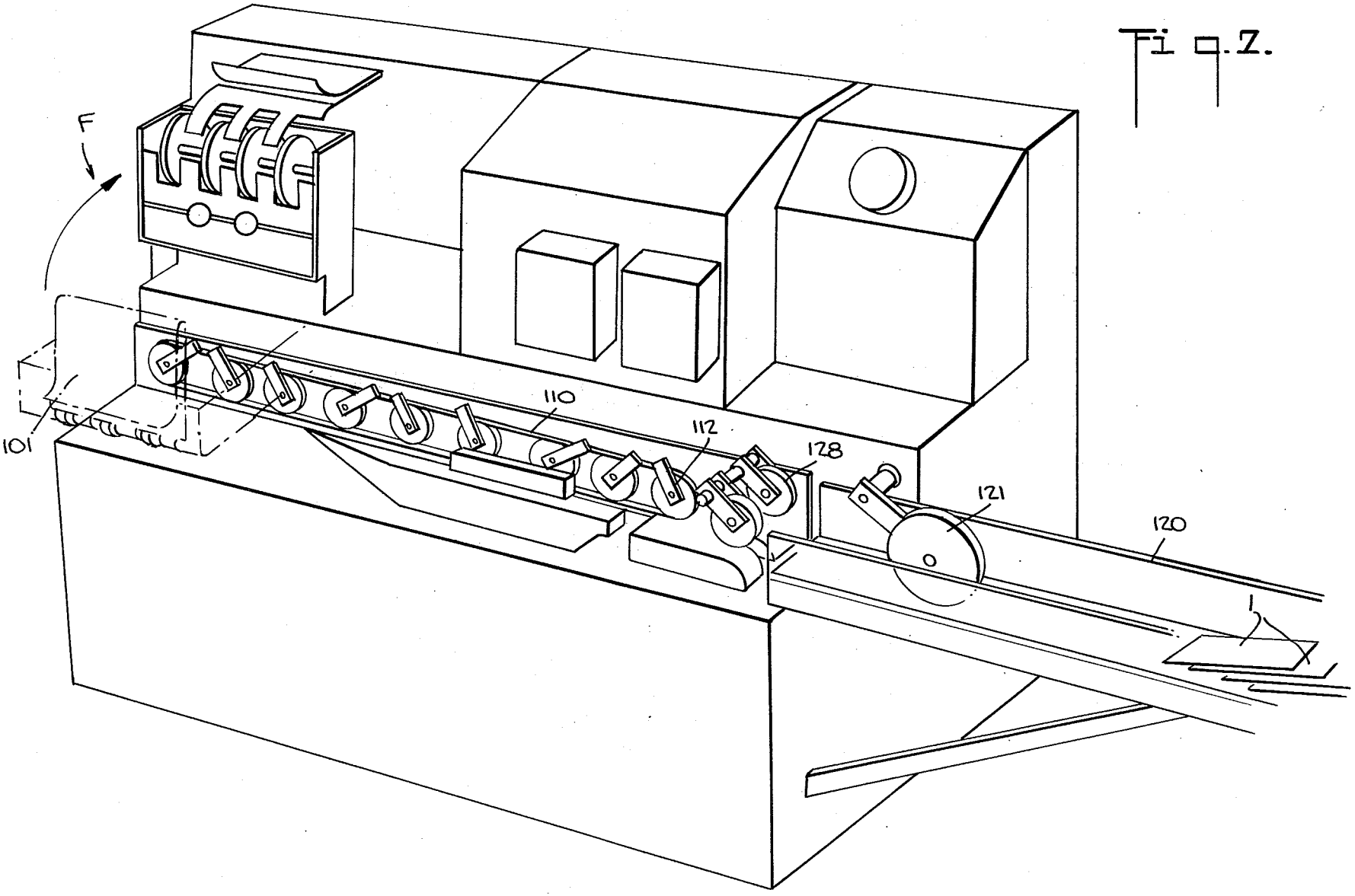
FIG. 7 is a perspective view showing the package sealing mechanism.

Referring to the drawings and more particularly to FIGS. 1 and 4, a number of travelers checks C and PAFs P are stacked in separate stacks. The checks are of the same denomination and are arranged numerically with their serial numbers in sequential order. The lowermost check has the lowest serial number and each check above the lowermost check having increasing higher serial numbers in sequential order.

The stack of PAFs P is preferably next to the stack of checks C and the serial numbers on each PAF P is arranged with the lowermost serial number on the bottom. The serial number of the lowermost PAF P and the serial number of the lowermost checks C correspond to each other and is the lowest number of a group of checks which are to be packaged with that particular PAF P. The next lowermost PAF has a serial number matching the lowest serial number of the next group of travelers checks C which are to be packaged with that second lowermost PAF P.

By way of example, if the serial number of the lowermost check C is "00", the serial number of the lowermost PAF P is also "00". However, since travelers checks C with serial numbers "00" through "09" are to be packaged with the PAF P having serial number "00" the second lowermost PAF P will have the serial number "10" and will be in position to be packaged with the next groups of travelers checks C having serial numbers "10" through "19". Hence, the serial numbers on the PAF P correspond with the lowest serial number of any group of checks C which are to be packaged with that particular PAF P.

A plurality of envelope blanks 2 are stacked together in an envelope feed section E. The envelope blanks 2 are first fed to a conveyor means. The PAF P and checks C are then fed to a position overlying the blank 2 and from which they may be deposited into the envelope blank 2. As set forth above, the PAF P and the checks C are deposited upside down on end panel so that the portion with the serial number overlaps the end panel 5. The envelope blank 2, with the PAF P and the checks 2 stacked thereon, is then moved beneath an insert station S where additional inserts I, such as advertisements, etc., are stacked on top of the previously stacked documents on the envelope blank 2.

The envelope blank 2, with the PAF P, the checks C and additional inserts I stacked thereon, is then moved to a folding and sealing station F which folds the blank 2 around the stacked documents and seals the edges and flap of the envelope blank to complete the package 1. The completed packages are then stacked together ready for shipment.

After the envelope blank 2 is fed to the conveyor, and the computer is made aware of this fact, the first document to be fed is the PAF P upon which a serial number is encoded with magnetic ink for character recognition so that it may be read optically with any reading device, such as a videcon camera. The serial number of the PAF P being fed is viewed by scanning and reading means 56–57 and compared with the serial number that the operator first keyed into the machine indicating what the first serial number should be. If the two serial numbers match, the logic then allows the checks C to be fed from its stack.

The serial number of the first check C fed is examined by the scanner and reader means 58–59 to ascertain that it is the same as the serial number on the PAF P that was just fed. If the two serial numbers match, then the remaining checks C which are to be packaged with that particular PAF P are fed from the check stack and the serial number on each check C is read for the next higher sequential number. If there is a gap in the sequence, the machine stops and alerts the operator of a malfunction.

When the proper number of checks C have been fed, a signal is sent to the controls indicating that all the checks C and the PAF P have been fed and that they are in fact in the proper position. At this point, if the envelope blank 2 is also in the proper position, the machine will then have completed one cycle. The envelope blank 2 with its documents stacked thereon are moved on and the next PAF P and corresponding checks C are fed and the cycle is repeated.

The comparison of the numbers read by the sensing means 56–59, such as videcon cameras, is examined and is then transmitted to a computer (not shown) where the actual comparison is done. In the event that a check is out of sequence or the wrong serial number is read or possibly no serial number at all is read, the computer stops the entire machine and an indication comes from the CRT tube to tell the operator which station is at fault and if possible what the problem is.

All of these functions are monitored by sensing means at different sections of the machine so that it is certain that each function of the cycle has been accomplished before the next group of travelers checks is fed. The logic diagram of FIG. 32 outlines the functions of the system and its safeguards.

Conveyor System

Figures 21, 22, 23, 24:
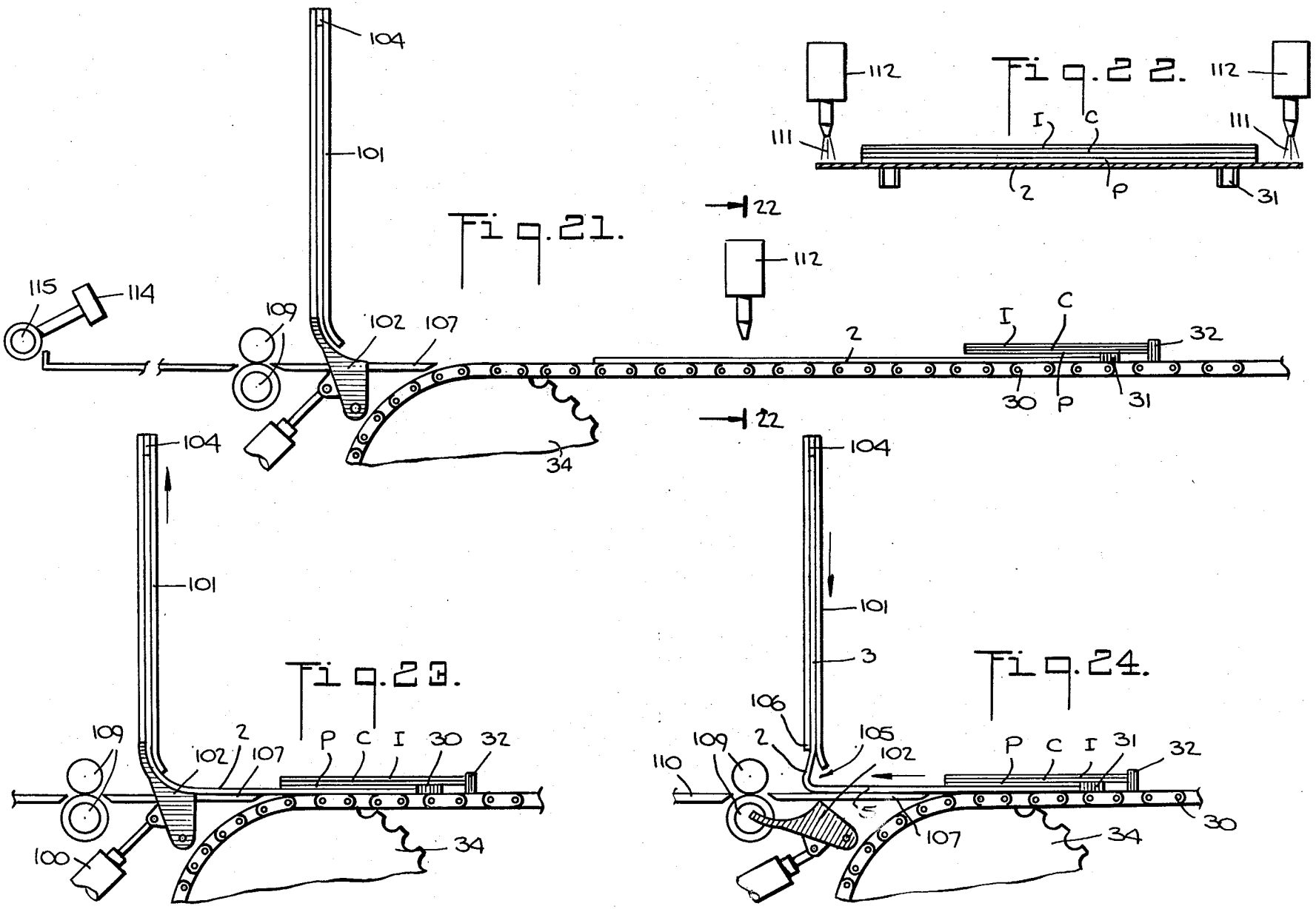
FIG. 21 is a schematic plan view of the envelope folding and sealing means.
FIG. 22 is a sectional view taken along line 22—22 of FIG. 21.
FIG. 23 is a detailed view showing the first step in the folding of the envelope blank.
FIG. 24 is a detailed plan view showing another step in the folding operation.
Figure 25:
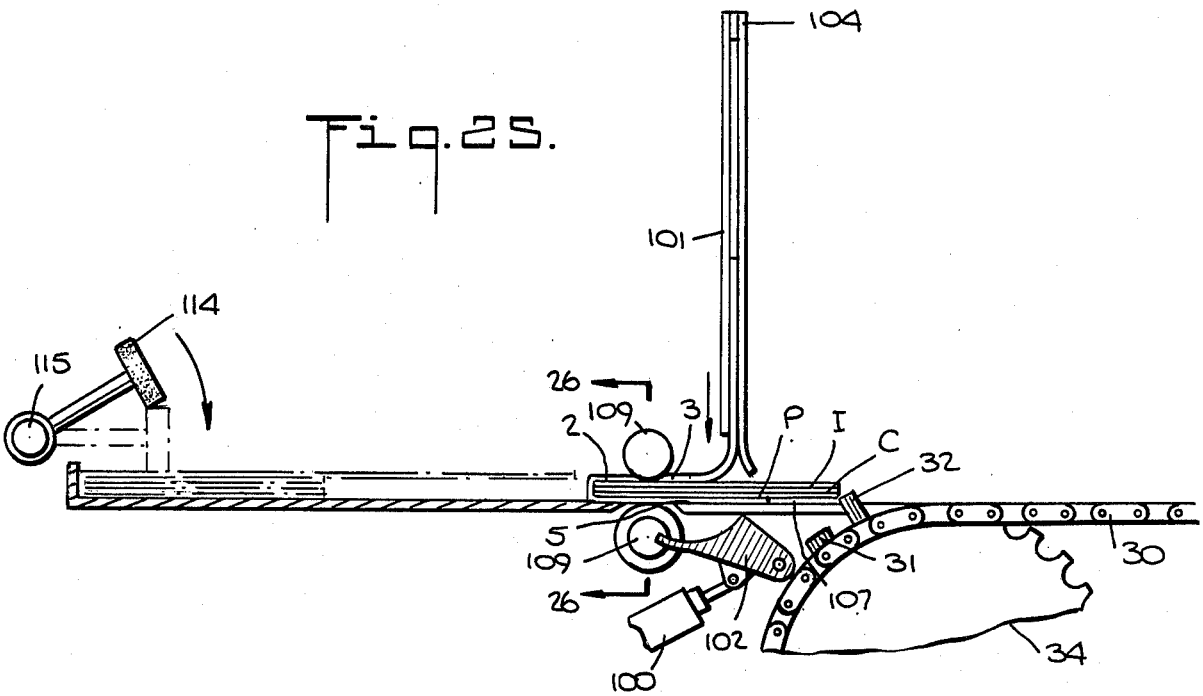
FIG. 25 is a detailed view showing still another step in the folding operation.
Figure 26:
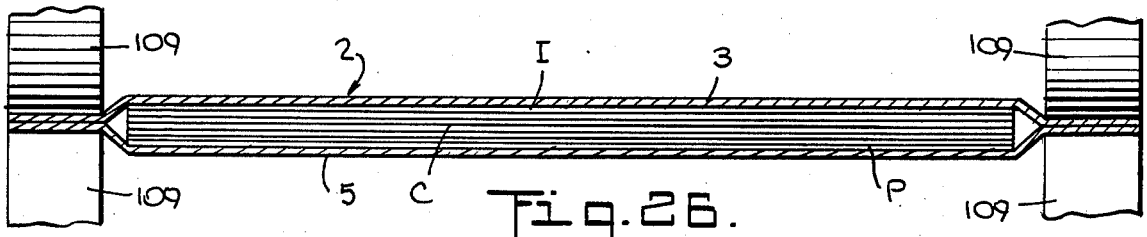
FIG. 26 is a sectional view taken along line 26—26 of FIG. 25.
Figure 28:
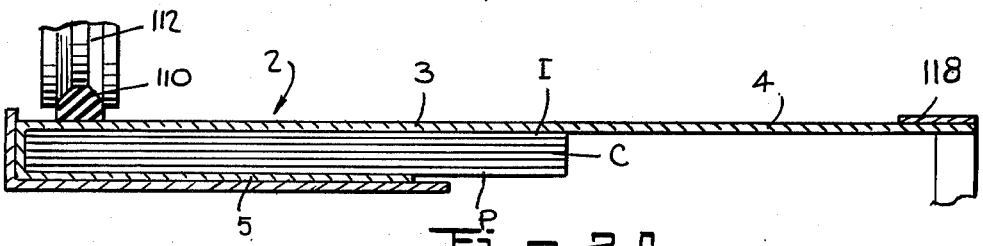
FIG. 28 is a sectional view taken along line 28—28 of FIG. 27
Figure 29:
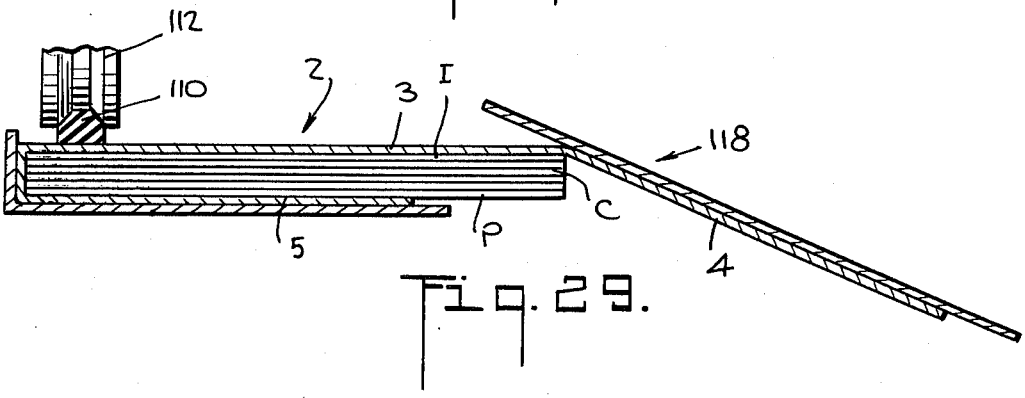
FIG. 29 is a sectional view taken along line 29—29 of FIG. 27.
Figures 27, 30, 31:
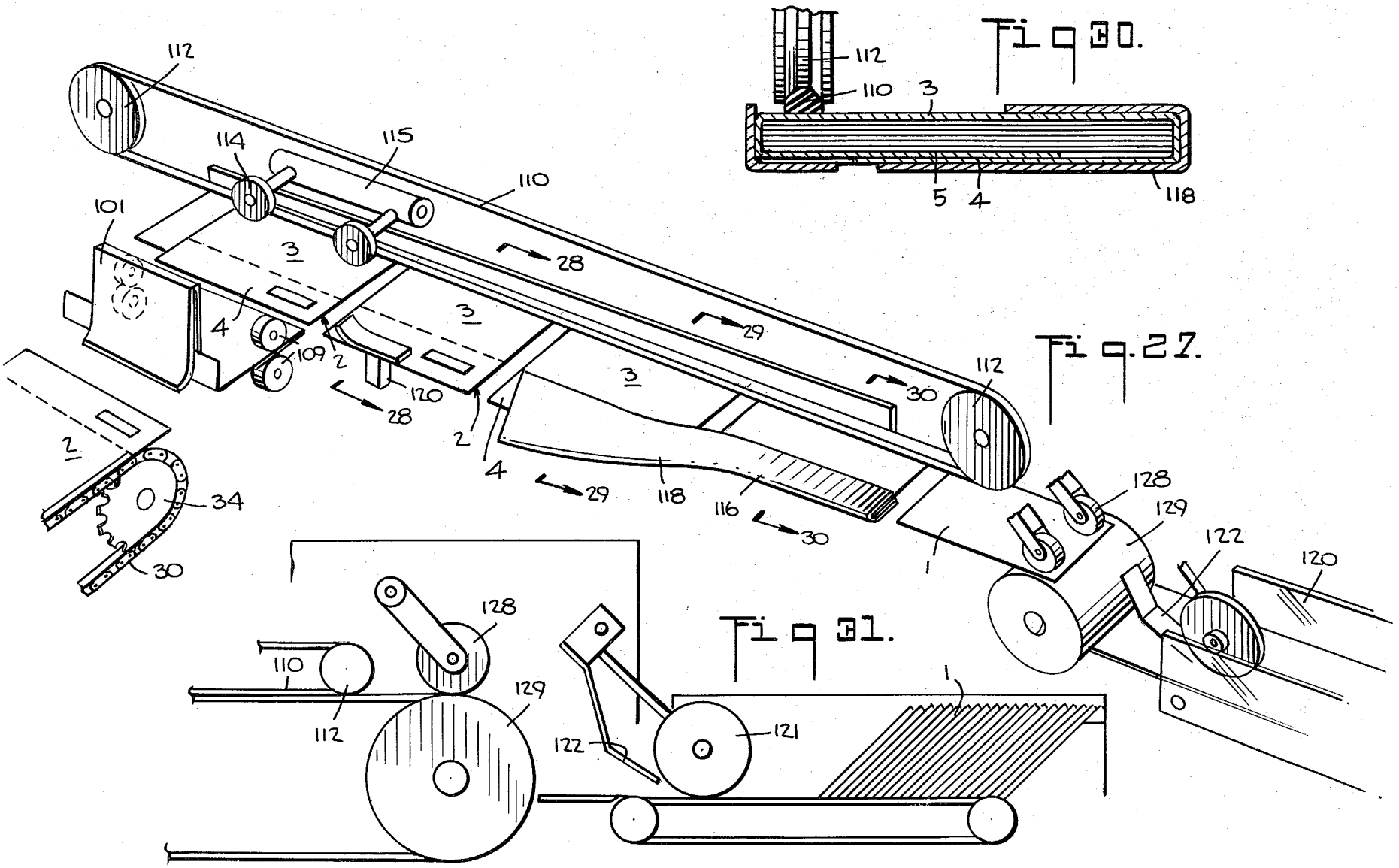
FIG. 27 is a perspective view showing the flap folding mechanism of the present invention.
FIG. 30 is a sectional view taken along line 30—30 of FIG. 27.
FIG. 31 is a diagrammatic plan view of the envelope stacking mechanism.
Figure 82:
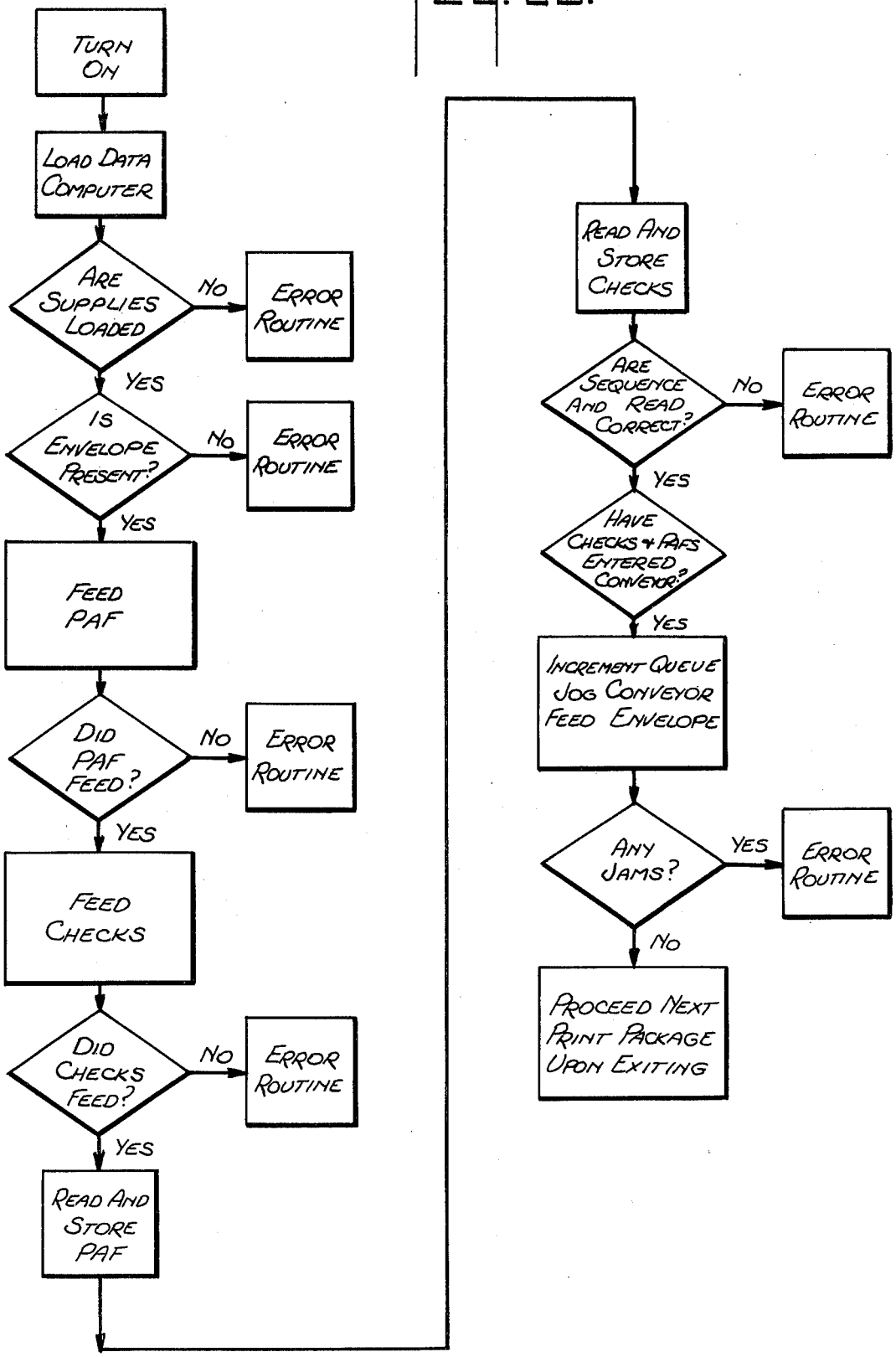

The conveyor system of the present invention comprises an endless chain conveyor 30 driven by suitable drive wheels 33 (FIG. 10) and 34 (FIG. 21). The conveyor 30 is located within a frame 36 and has a plurality of upstanding pins 31 and 32 mounted thereon which move with it. The pins 31 are adapted to strike the envelope blanks 2 to move them along. The pins 32 are taller than pins 31 are spaced rearwardly therefrom, and are adapted to strike the documents, such as PAF P and checks C, to be stacked on the envelope blanks 2, and allow them to be deposited thereon and to be moved along. Since pins 31 are shorter than pins 32, the pins 31 operate on the envelope blanks and the pins 32 operate on the documents P, C etc. When the envelope blanks 2 are deposited onto the conveyor 30, the pins 31 strike the rear edge of the envelope blank 2 to move it along with the conveyor 30. The pins 31 are adapted to strike and move the envelope assembly 2. The pins 32 cause the additional documents to be deposited onto the envelope blanks 2 and to move them along with the envelope blanks 2.

Envelope Blank Feeder

Figure 8:
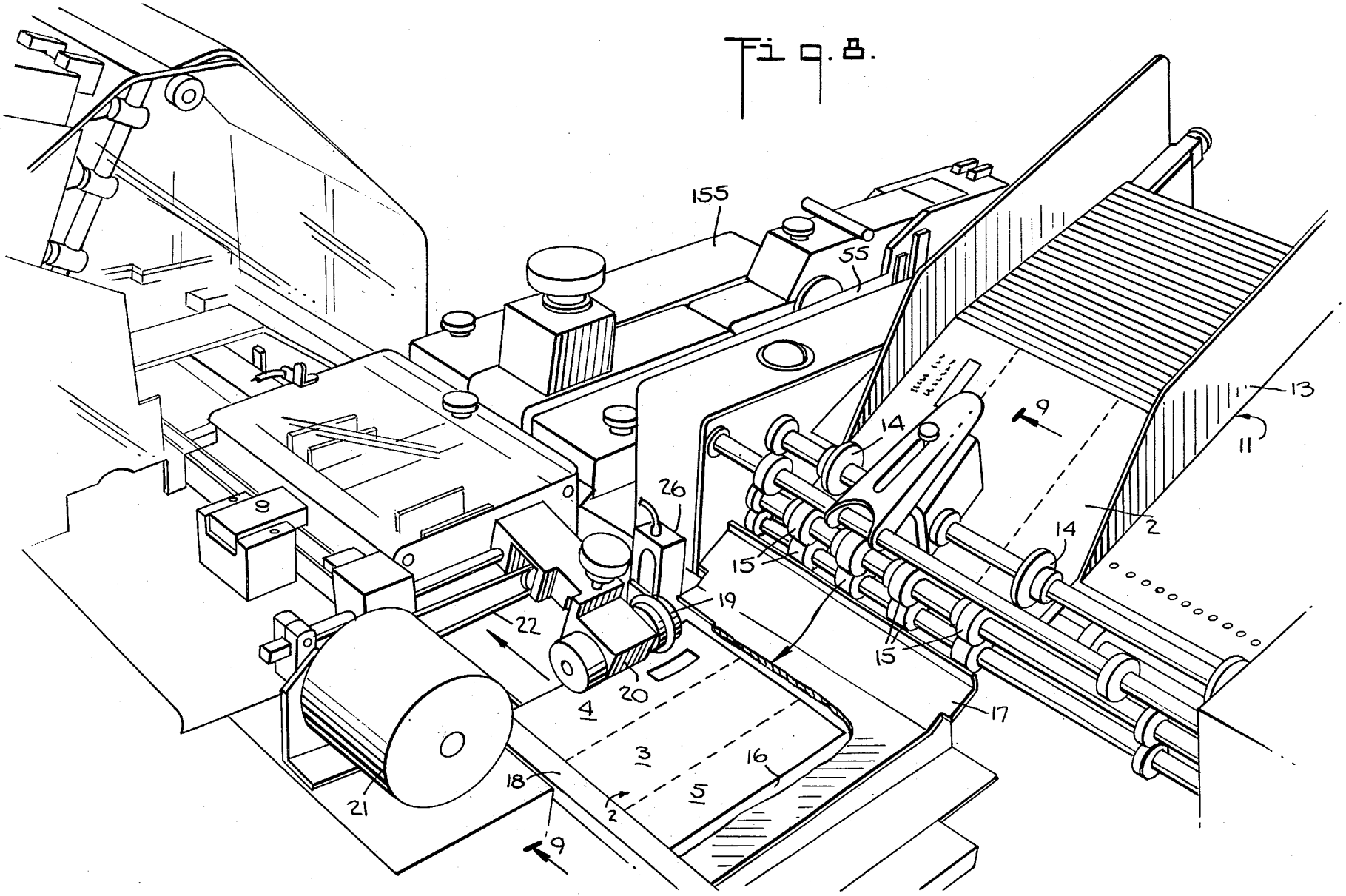
FIG. 8 is a perspective view showing the blank feeding mechanism.
Figure 10:
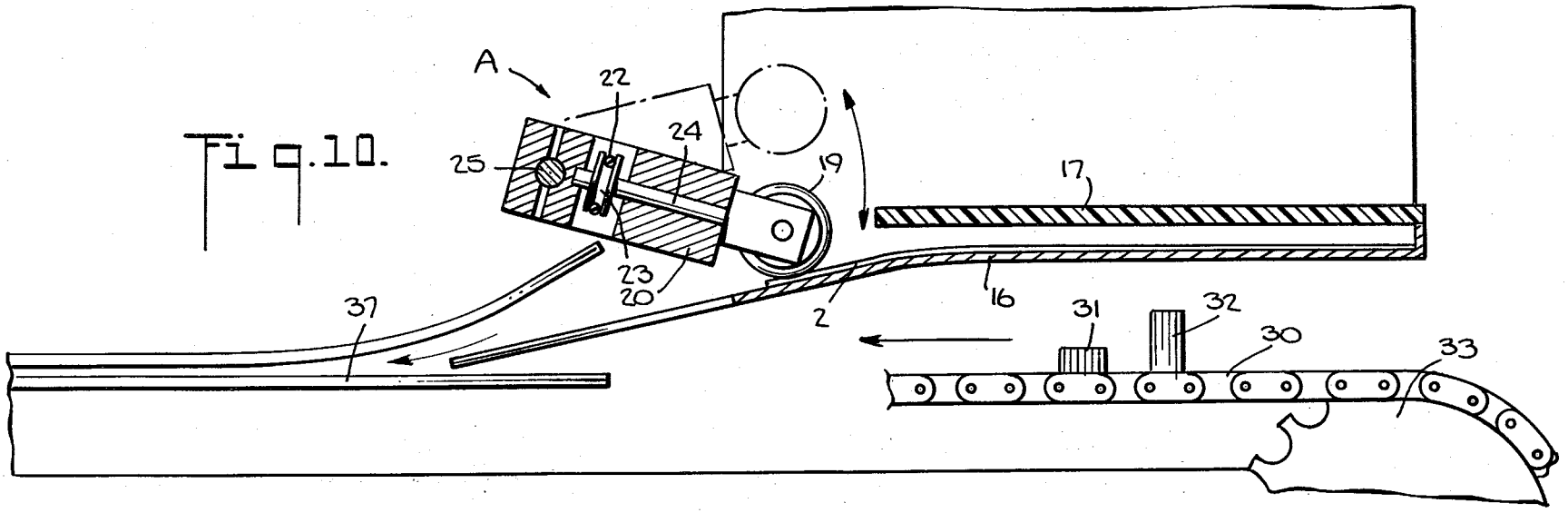
FIG 10 is a sectional view taken along line 10—10 of FIG. 9
Figure 9:
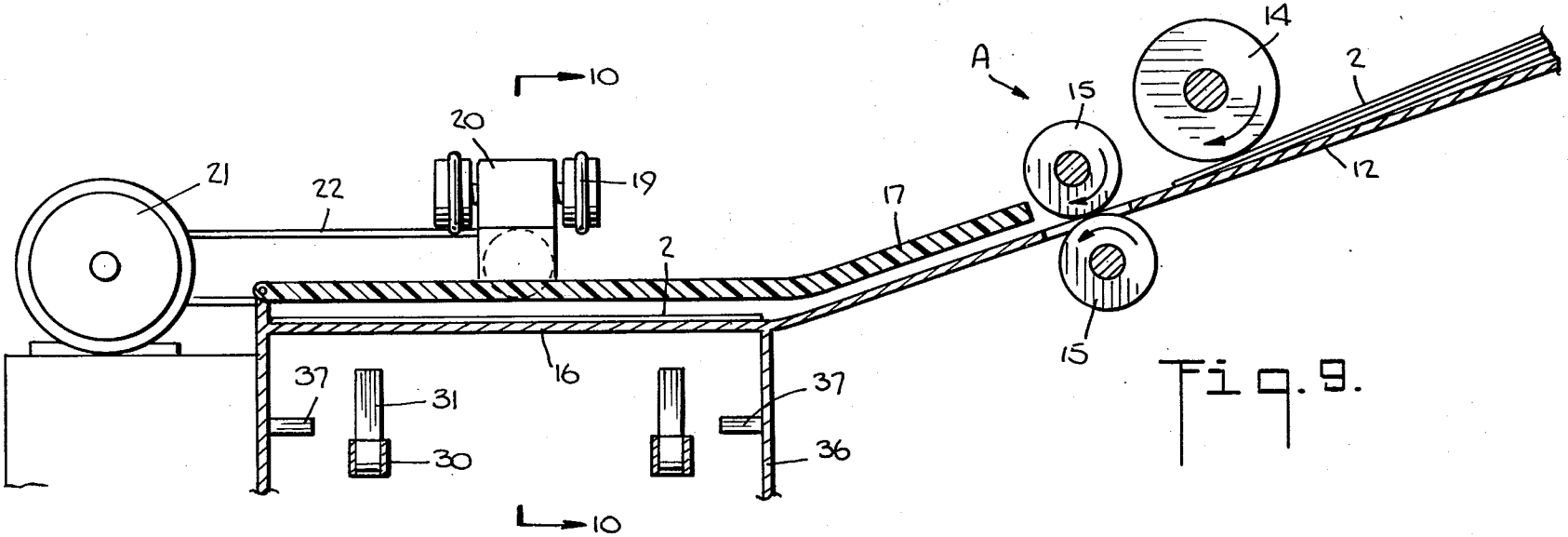
FIG. 9 is a sectional view taken along line 9—9 of FIG. 8.
Figure 11:
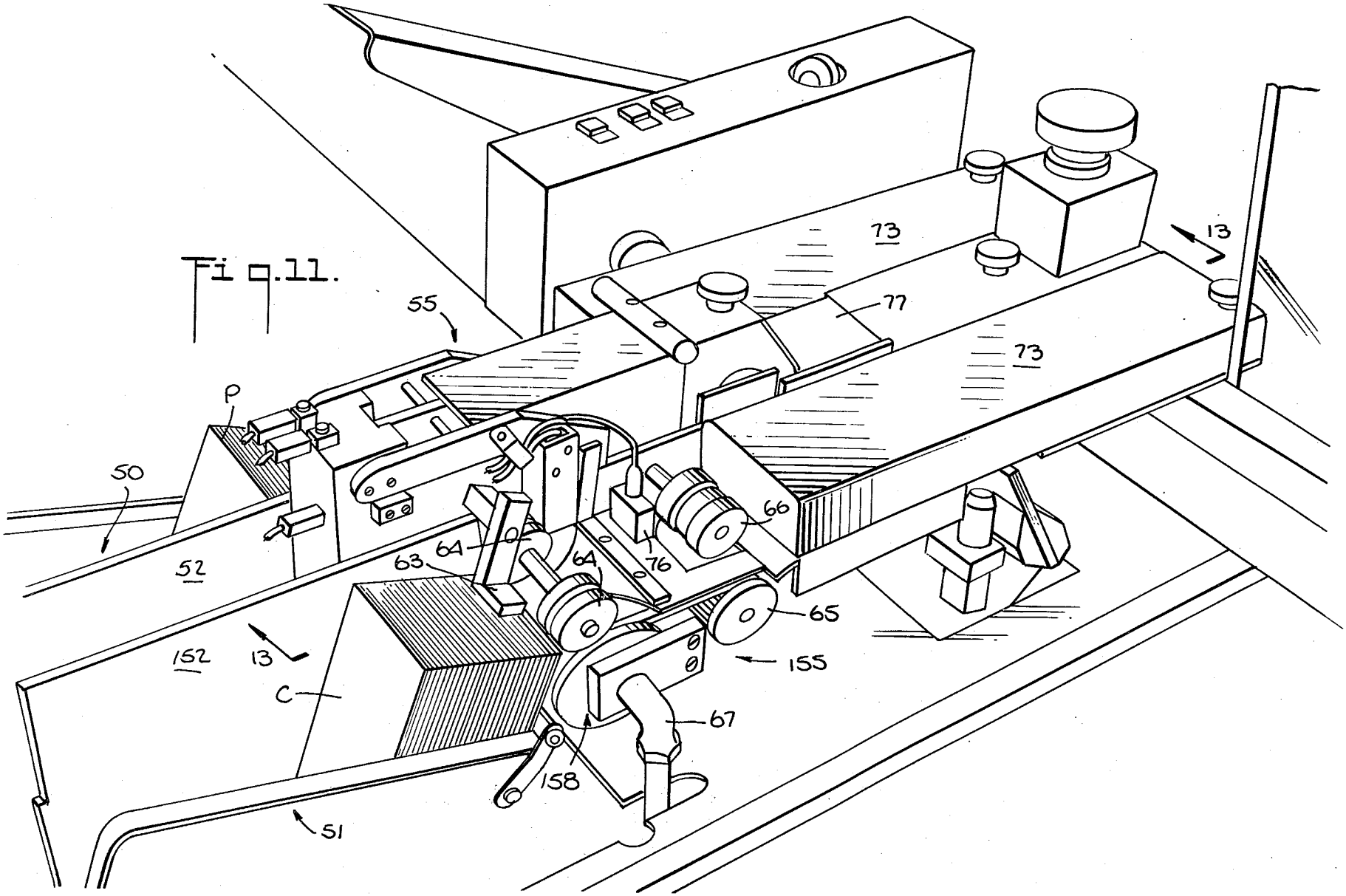
FIG. 11 is a rear detailed perspective view of the document feeding mechanism.
Figure 12:
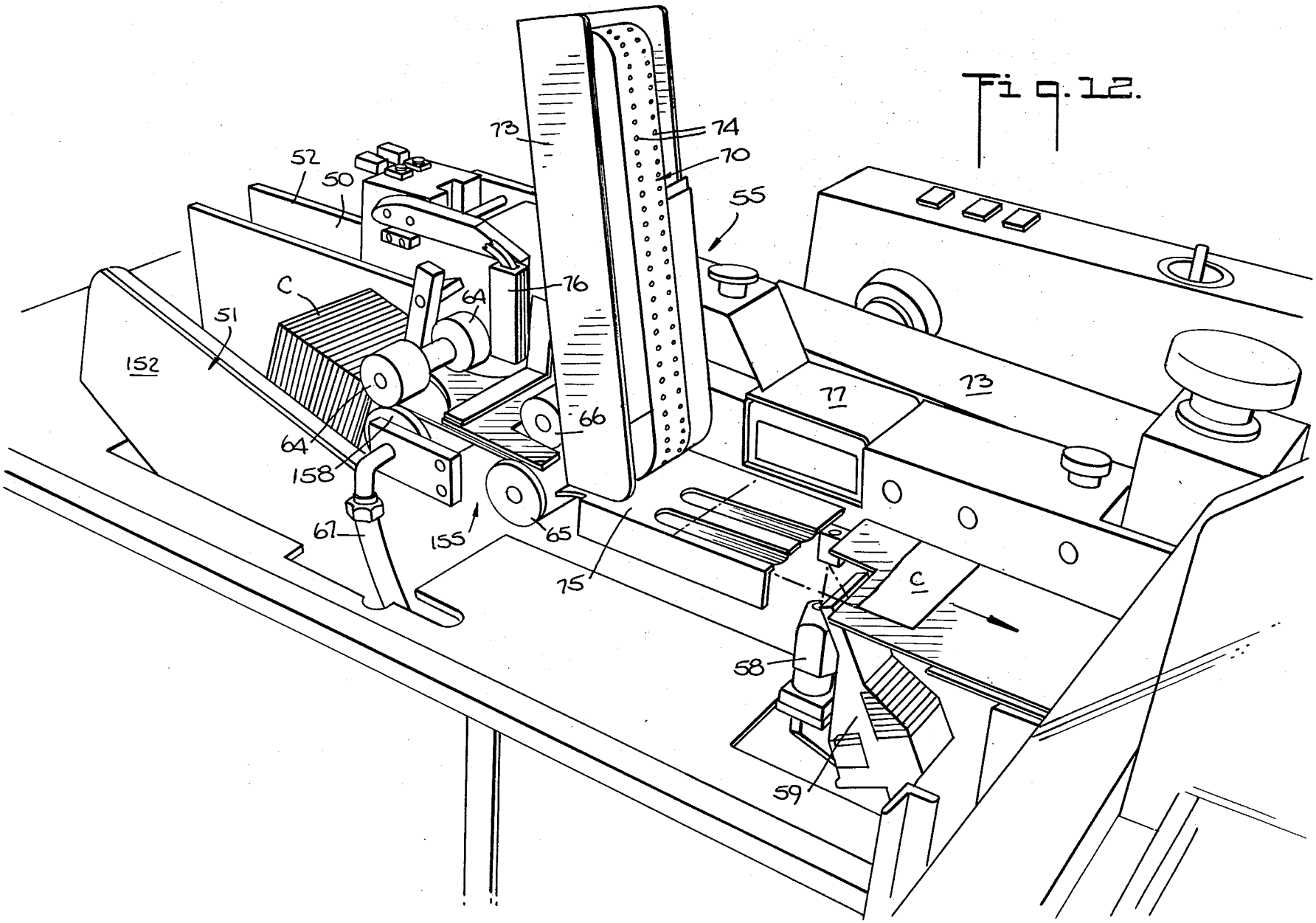
FIG. 12 is a front detailed perspective view of the document feeding mechanism.
Figures 13, 14:
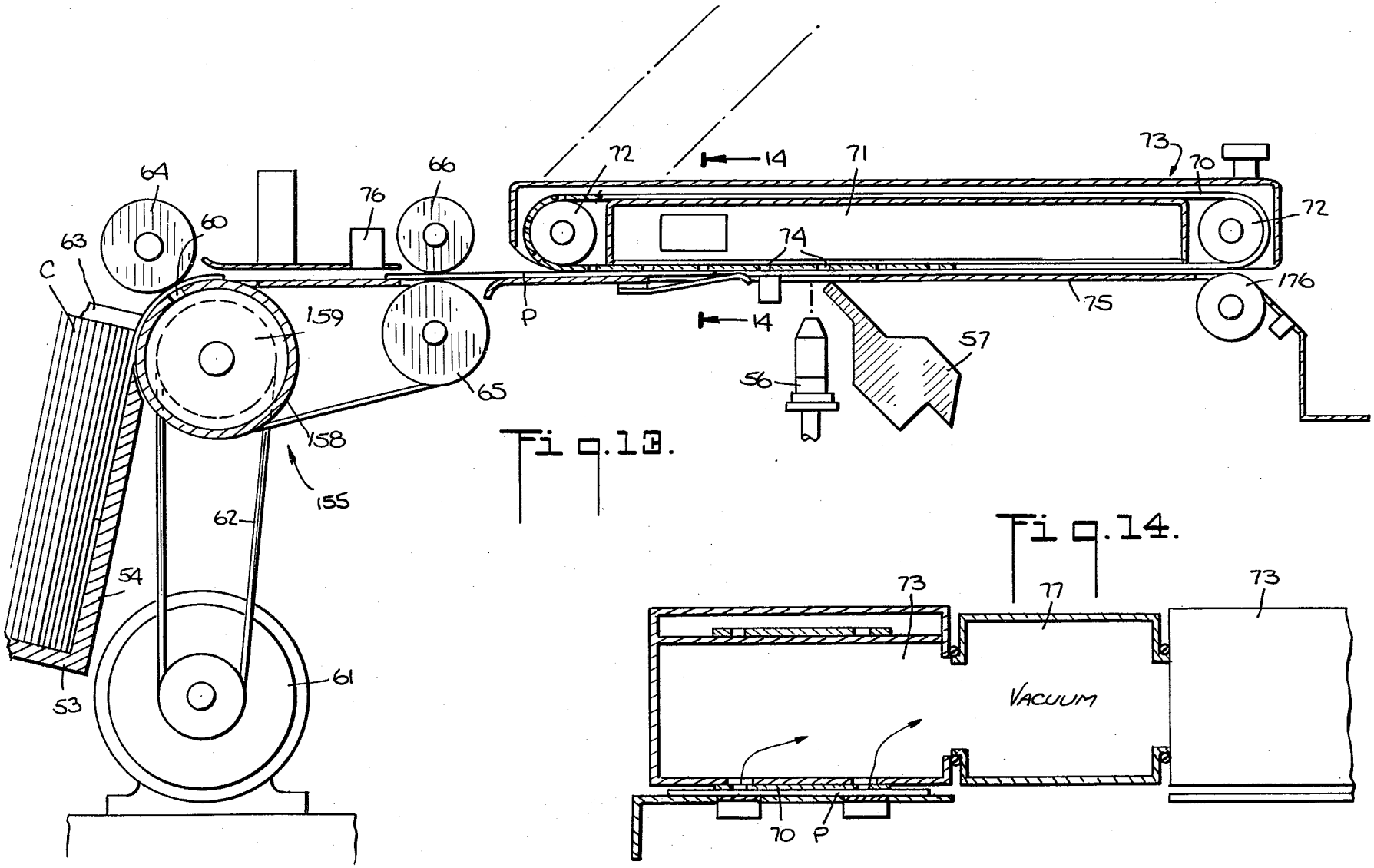
FIG. 14 is a perspective view taken along line 14—14 of FIG. 13.
Figure 15:
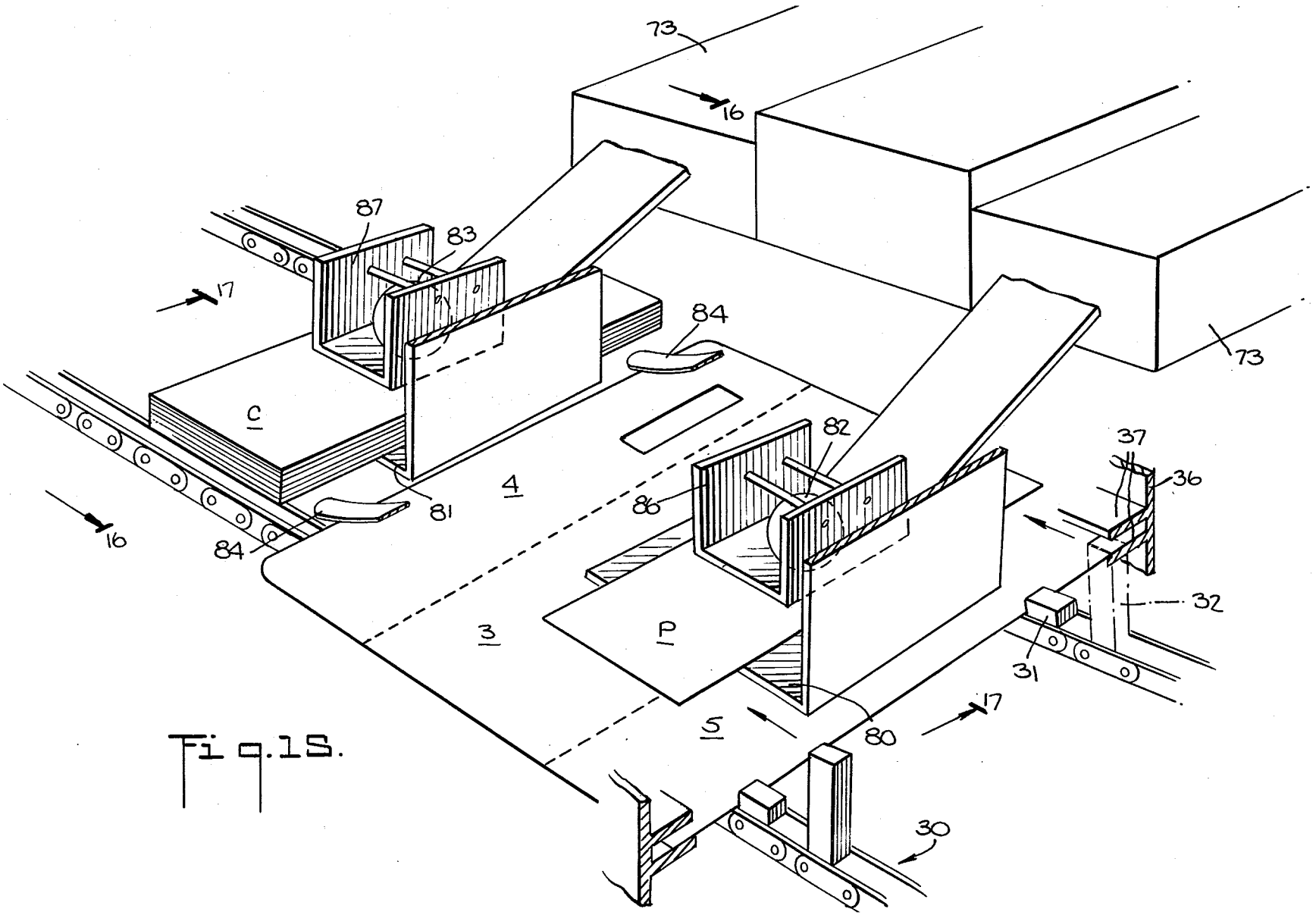
FIG. 15 is a perspective view showing the document support mechanisms for supporting the documents before deposition on an envelope blank.
Figure 16:
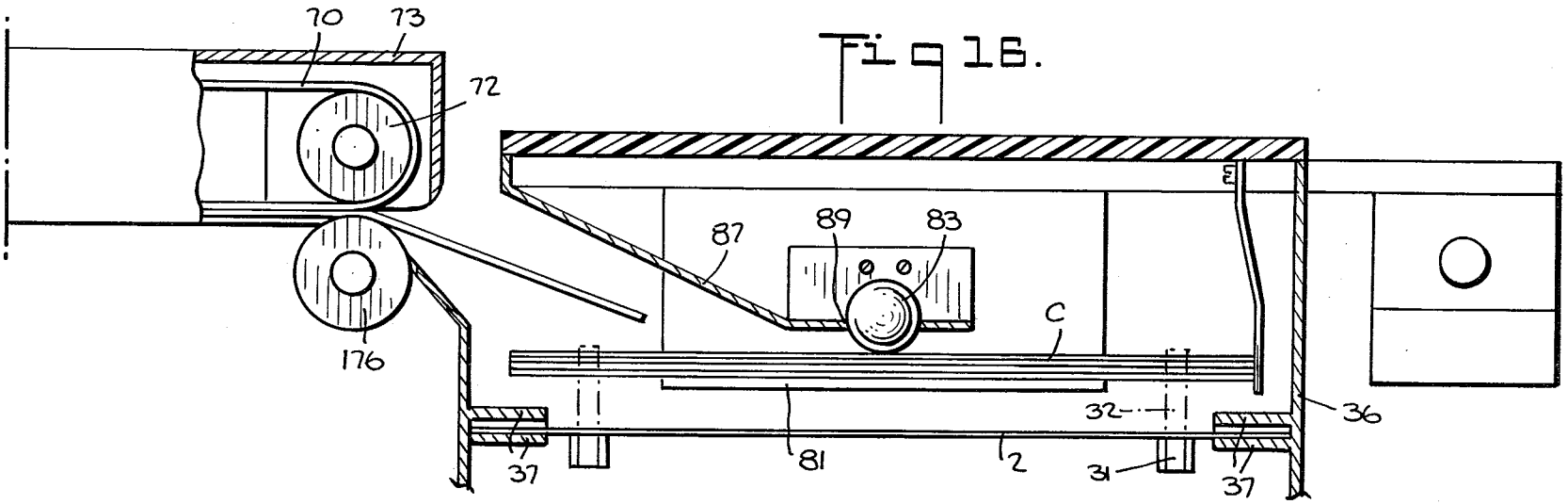
FIG. 16 is a sectional view taken along line 16—16 of FIG. 15.
Figure 17:
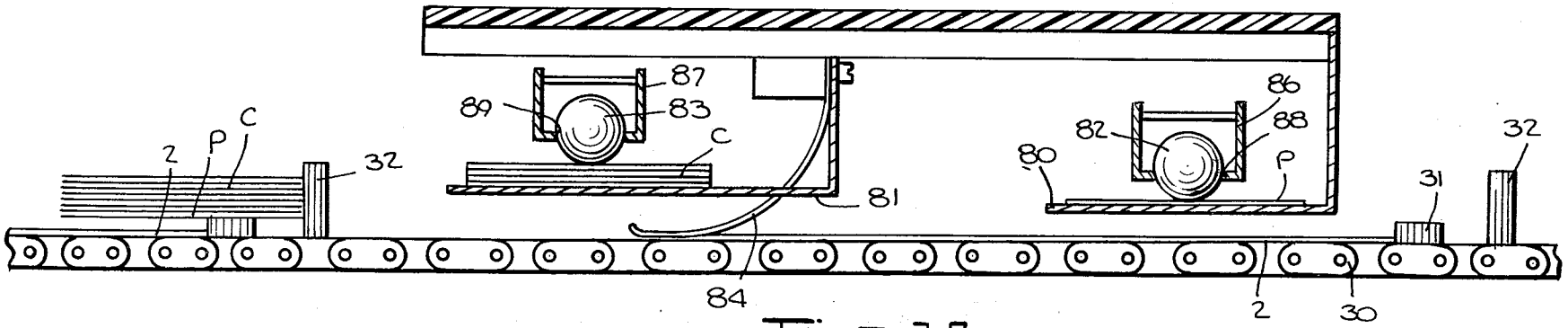
FIG. 17 is a sectional view taken along line 17—17 of FIG. 15.
Figure 18:
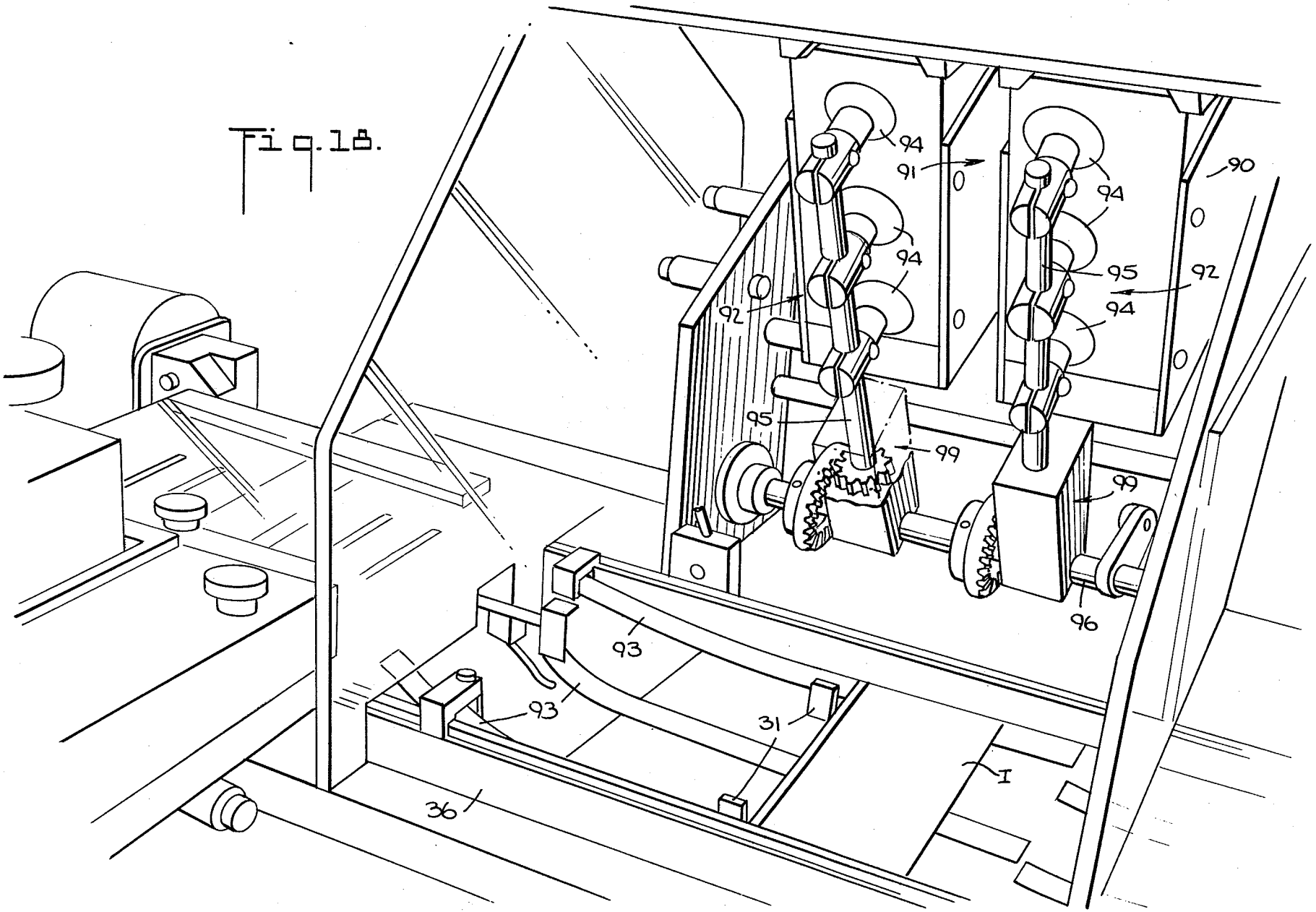
FIG. 18 is a detailed perspective view showing the additional insert feeding mechanism.
Figure 20:
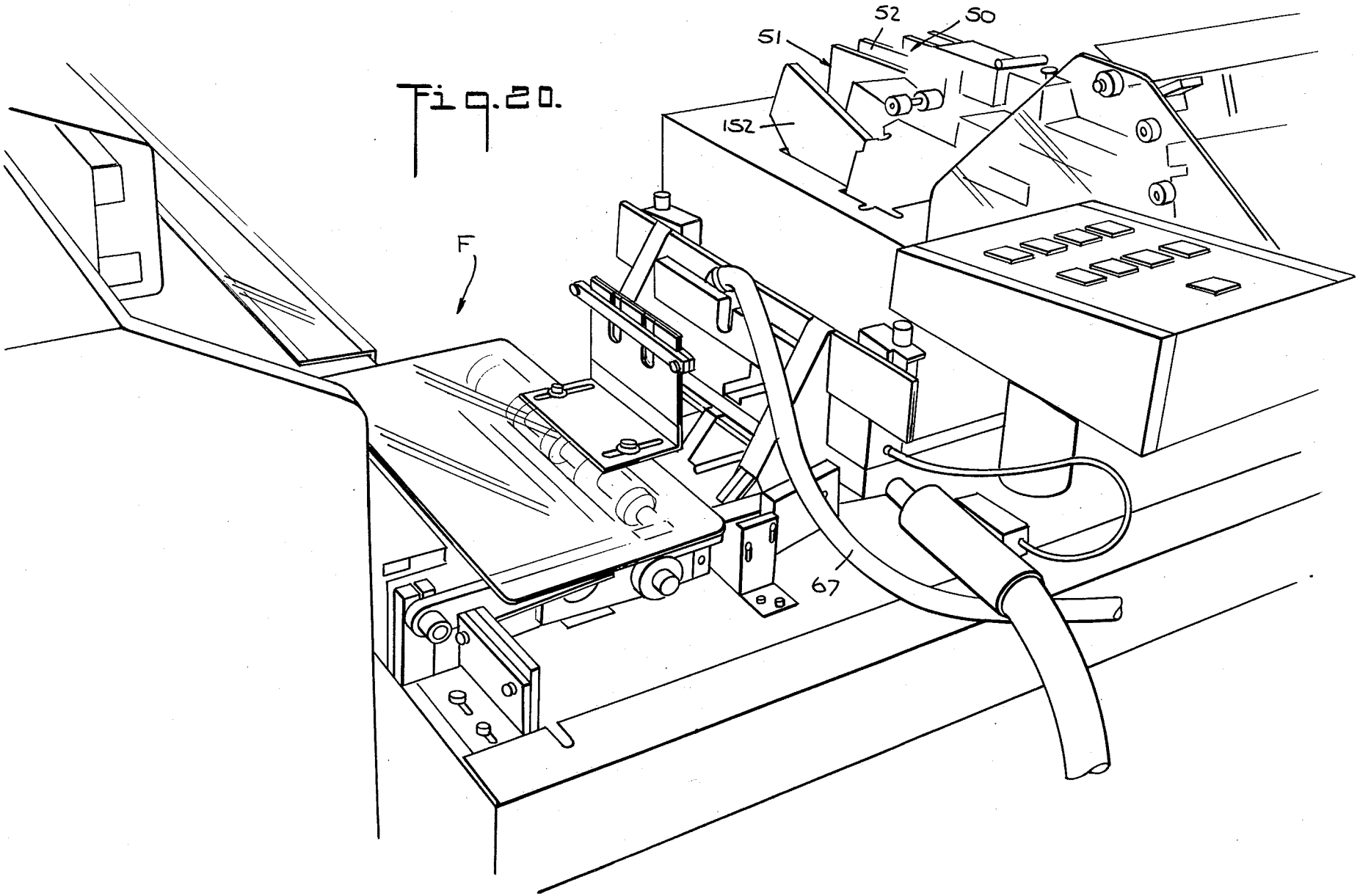
FIG. 20 is a detailed perspective view of the mechanism for transferring the envelopes to the envelope sealing mechanism.

The envelope blank feeder mechanism E of the present invention is shown in FIGS. 8 to 10 and comprises a feed tray 11 in which the envelope blanks 2 are stacked. The feed tray 11 has an inclined bottom wall 12 and side walls 13. A feeder mechanism assembly A is provided which comprises take-off roller 14 and feed rollers 15 at the lower edge of the tray bottom 12. The take-off rollers 14 remove the uppermost blank 2 from the tray 11 and directs it to feed rollers 15 which moves the blank 2 onto a holding platform 16 beneath cover 17 and above the conveyor 30.

The envelope blank 2 is removed from the platform 16 and onto a pair of support rails 37 extending inwardly from chamber 36 by a rotatable take-off wheel 19 mounted perpendicularly to the tray 11 and in front of the cover 17. The take-off wheel 19 is mounted on an arm 20 and is rotated by motor 21 through belt 22, wheel 23 and shaft 24. The arm 20 is mounted on a pivotal shaft 25 which rotates the arm 20 and wheel 19 upwardly and downwardly. On its downward stroke the wheel 19 engages an envelope blank 2 and removes it from platform 16 and moves it to a position on rails 37. As the conveyor 30 moves along, the pins 31 strike the rear edge of envelope blank 2 and moves the envelope blank 2 off the rails 37 and onto the conveyor 2. A detection unit 26 is provided to detect the presence of an envelope blank 2 on the conveyor 30 and if its presence is detected it will move the conveyor 30 forward.

Document Feed Mechanism

The feed mechanism for the PAF P and the checks C are shown in FIGS. 11 through 17 and comprises a hopper 50 for a stack of PAF's P and another hopper 51 for the checks C. The two hoppers 50 and 51 are located adjacent each other and are constructed and operate in a similar manner.

The PAF's P and the checks C are stacked in the hoppers 50 and 51 which have sidewalls 52 and 152, respectively, bottom wall 53 and an inclined front walls 54. The PAF's P and the checks C are stacked on the front wall 54 facing down with their end edges on the bottom wall 53. They are fed individually by a vacuum feed assembly 55 and 155, respectively, passed the scanner and reader system 56–57 and 58–59.

The vacuum feed assemblies 155 comprise a vacuum feed roller 158 having a hollow interior core 159 with a vacuum opening 60 on its periphery. The roller 158 is rotated by drive means 61 through belt 62 and receives vacuum from tubing 67.

The upper end of the lowermost documents C or P lies adjacent the roller 158 and a stop member 63 retains all the documents C and P with the exception of the lowermost one. Air is withdrawn from hollow core 59 to create a vacuum at opening 60 so that as roller 158 rotates and its opening 60 moves adjacent the lowermost one, document P or C is fed from its respective hopper.

The feed rollers 65 and 66 feed the document to a vacuum belt 70 which is housed in a vacuum assembly 73 comprising a vacuum chamber 71 and drive wheels 72 for the vacuum belt 70. The vacuum is supplied vacuum chamber 71 through a manifold 77. The belt 70 has a plurality of spaced parallel vacuum openings 74 which grasp each document P or C and move it along over a support plate 75 over scanner and reader 58–59 or 56–57 until it is deposited by roller 176 onto trays 80 and 81 over the conveyor 30.

The documents are moved past a reading mechanism 56–57 or 58–59 which reads the serial numbers on the PAF P and the serial numbers on the checks C. The trays 80 and 81 are provided with a detecting mechanism 76 which detects whether the documents P and C have been fed. The PAF P and the checks C are fed onto holding trays 80 and 81, respectively, overlying the conveyor 30.

The documents P and C are held on the platforms 80 and 81 by downward pressure exerted by pressure ball 82 and 83 in holders 86 and 87 located above the platforms 80 and 81 and having openings 88 and 89 in which the balls 82 and 83, respectively, sit. A detector 84 indicates that the envelope blank 2 is in the proper position so that the upstanding pins 32 of the conveyor 30 may move along to strike ends of the PAF P and checks C to move them off platform 80 and 81 and deposit them onto the envelope blank 2. The conveyor 30 moves forward only when the proper number of checks C have been stacked on the platform 81.

Additional Insert Feed

If desired, additional inserts I may be packaged with the travelers checks C and an additional feed mechanism S is shown in FIGS. 6 and 18 to 20.

A pair of insert holding trays 90 and 91 are provided above the conveyor 30. The lowermost inserts I in each tray are adapted to be picked up by vacuum arm assemblies 92 and deposited onto spaced holding rails 93 overlying the conveyor 30. Each vacuum arm assembly 92 comprises a plurality of vacuum heads 94 which are mounted on a rotatable shaft 95 which is adapted to be moved upwardly by a shaft 96 so that the heads 94 are movable upwardly and downwardly at the same time they are being rotated.

Vacuum pick-off 98 (FIG. 19) along the edge of the trays 90 and 91 separate the lowermost insert I from the rest of the inserts. This lowermost insert is then removed by the suction heads 94 which receive vacuum from the manifold 99. The heads 94 rotate downwardly to deposit the documents onto the rails 93. At this point, the conveyor pins 32 will pick up the inserts I from the holding rails 93 to deposit them onto the stack of documents P and C on the envelope blank 2.

Sealing and Folding Mechanism

When the stack of documents and inserts C, P, and I is completed, the conveyor 30 moves the stacked documents to a sealing and folding mechanism F as shown in FIGS. 21 to 31.

The sealing and folding mechanism F comprises an upwardly directed ramp 101 and a directing arm device 102 adapted to direct the leading edge of the blank 2 onto the ramp structure 101. As the pins 31 and 32 move the envelope assembly 2 together with documents C, P and I forward, the directing device 102 is in its raised position by means of piston 100 so that the leading edge of the envelope blank 2 moves up the ramp 101 until it strikes a stop 104. At that point, the directing device 102 is lowered by piston 100 to open a gap 105 between lower edge 106 of ramp 101 and a feed plate 107. As the pins 31 and 32 continue to move the blank 2 forward the envelope assembly 2 buckles along a fold line between panels 3 and 5 and the folded envelope assembly 2 is pushed through the gap 105.

The edges of the envelope blanks 2 have had adhesive 111 applied thereto by applicators 112 before the envelope blanks reach the ramp 101. Rollers 109 at the edge of the blank move faster than conveyor 30 so that as soon as the envelope 2 starts moving through gap 105 the rollers 109 pull it through the gap and beneath belt conveyor 110 by feed rollers 114. The rollers 109 also press the edges of the blank 2 together to seal the edges with the adhesive 111 which has been previously applied thereto.

The folded and edge sealed envelopes 2 are then moved by belt conveyor 110 which is powered by drive means 112 which is at an angle (preferably at a right angle) to the first conveyor 30. Feed rollers 114 are mounted on a pivotally movable shaft 115 to apply pressure to the envelopes 2 to force them beneath conveyor 110. Shaft 115 rocks upwardly to raise the rollers 114 to permit envelopes 2 to be deposited under conveyor 110 and then rocks downwardly to lower rollers 114 to apply pressure to envelope 2. The rocking of shaft 114 is timed to the movement of the directing mechanism 102.

The belt conveyor 110 moves the envelopes 2 past a flap-folding shoe 118 which is especially contoured to fold the flap 4 as each envelope 2 moves past it. An adhesive is applied to flap 4 by applicator 120 as the envelope 2 moves past it. The shoe 118 has a bend 116 which terminates in a U-shaped configuration to fold the flap 4 to complete the package. The completed packages are then moved past take-off rollers 128 cooperating with rollers 129 to remove packages from the sealing and folding mechanism and move them off the conveyor 110 and onto the stacker 120 which will stack the completed packages.

Feed roller 121 and detecting arm 122 monitors the presence of package 1.

The present invention may also be used for a "mixed pack" whereby a package of checks may be made up of ten dollar checks, twenty dollar checks, fifty dollar checks, etc. depending on the amount desired. By optically reading the serial numbers, the apparatus may be modified to allow for "mixed packs". This would be done by using several stacks of checks of different denominations and programming the control mechanism to read the serial numbers of the several checks.

It will be seen that the present invention provides for an improved machine and method of packaging travelers checks which enables the documents to be read as they are assembled for insertion into an envelope so that the documents may be positively identified as the correct ones for inclusion in a particular envelope and includes fixed check points throughout the entire system to be certain that the proper checks are inserted into the proper envelope.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechansim for packaging travelers checks having serial numbers thereon in an envelope, each envelope blank has a central panel, an end panel and a kite flap, said end panel being narrower than the forms and checks, and said forms and checks being deposited on said end panel with a portion thereof containing the serial number of the forms and checks extending beyond said end panel, comprising conveyor means, means for moving said conveyor means, means for depositing an envelope blank on said conveyor means, means for depositing a purchase agreement form having a serial number on said envelope blank, means for depositing travelers checks having serial numbers thereon on said envelope blank, first detecting means for reading said serial numbers on said form and for reading the serial numbers on said checks, means connected to said first detecting means for determining whether the serial numbers on said checks and said forms are in a predetermined sequence, and means connected to said first detecting means for determining whether the serial number on the form to be associated with a particular envelope blank corresponds to the lowest serial number on the checks to be associated with said particular envelope blank, second detecting means are provided for determining whether the envelope blank has been fed, third detecting means are provided to detect whether a form and a check has been fed and means are provided whereby detection by any of said detecting means or determining means of a malfunction will result in stopping the operation to permit the malfunction to be corrected, a storage tray is provided to hold the envelope blanks and wherein means are provided to feed envelope blanks from the tray to a first holding means, means for removing the envelope blanks from the said first holding means and depositing them on the conveyor means, said forms and checks being stored in storage trays and vacuum means being provided to remove each from its respective tray and deposit them on second and third holding means, respectively, said vacuum means including vacuum belts to transport the forms and the checks from the storage trays to said second and third holding means and said first detecting means underlying said vacuum belts to read the serial numbers on the forms and the checks, means to remove the forms and the checks from the said second and third holding means and depositing them on said conveyor means, said removing means comprising upstanding pin means on said conveyor means to remove the envelope blanks, the forms and checks from their respective first, second and third holding means and deposit them on the conveyor means, said pin means comprising first pins for removing the envelope blanks and second pins for removing the checks and forms, said first and second pins being of different heights, said first pins being shorter than and forward of said second pins, said first pins being adapted to remove the envelope blank from said first holding means and depositing it on the conveyor means, said second pin being adapted to remove the forms and checks from said second and third holding means and deposit them on said end panel of said blank so that said forms and checks extend beyond said end panel, means for folding the envelope blank around said form and said travelers checks and means for for sealing the edges of the blank.

2. A mechanism as claimed in claim 1 wherein said forms and said checks are held in place in the second and third holding means by hold-down ball means.

3. A mechanism as claimed in claim 1 wherein the kite flap of the blank has a window therein which will coincide with the serial number on the extending portion of the forms and checks when the blank is folded around the forms and checks so that the said serial number is visible through the window.

* * * * *